United States Patent [19]

Dahlgren

[11] 4,082,493

[45] Apr. 4, 1978

[54] GAS BURNER CONTROL SYSTEM

[75] Inventor: Vincent M. F. Dahlgren, Pomona, Calif.

[73] Assignee: Cam-Stat Incorporated, Los Angeles, Calif.

[21] Appl. No.: 760,811

[22] Filed: Jan. 19, 1977

[51] Int. Cl.[2] ..... F23Q 9/08

[52] U.S. Cl. ..... 431/25; 431/46

[58] Field of Search ..... 431/24, 25, 26, 46, 431/51–56, 59

[56] References Cited

U.S. PATENT DOCUMENTS

| | | | |
|---|---|---|---|
| 3,449,055 | 6/1969 | Blackett | 431/46 |
| 3,574,495 | 4/1971 | Landis | 431/26 |
| 4,000,961 | 1/1977 | Mandock | 431/25 |

*Primary Examiner*—Carroll B. Dority, Jr.

*Attorney, Agent, or Firm*—Harris, Kern, Wallen & Tinsley

[57] ABSTRACT

A system for controlling the pilot and main burner gas valves of a gas furnace or the like, including a pilot spark ignitor and a pilot flame sensor. A system with both pilot and main burners normally off, with the pilot burner being turned on when the thermostat switch closes and with the main burner being turned on when the pilot flame is established, with the main burner being turned off whenever the pilot flame goes out. An electronic circuit with the flame sensor as an input for switching the main burner valve solenoid on and off, with the electronic circuit having a fail safe configuration such that failure of any component between the flame sensor and the relay controlling the main valve solenoid will result in the solenoid being unenergized.

16 Claims, 3 Drawing Figures

U2

| A | B | C |
|---|---|---|
| H | H | H |
| L | H | L |
| H | L | L |
| L | L | A |

GAS BURNER CONTROL SYSTEM

BACKGROUND OF THE INVENTION

This invention relates to gas burner controls for furnaces and the like, and in particular to a new and improved main burner valve control. The system utilizes a pilot burner with valve and valve solenoid, and a main burner with valve and valve solenoid. The system also includes a pilot burner flame sensor and an electronic circuit responding to a sensed flame for switching between a pilot burner ignition condition and a main burner on condition.

The main burner in a gas furnace or other gas powered device normally is ignited by a pilot burner and in the past, the pilot burner was maintained on all the time. However in order to save fuel costs, newer systems are being provided where the pilot burner is normally off and is turned on only when it is desired to turn on the main burner. When the system is to be turned on, such as when a thermostat switch closes, the fuel is supplied to the pilot burner by energizing a pilot valve solenoid. A spark ignitor circuit is also energized producing a spark at the pilot burner for igniting the pilot burner. When a flame is established at the pilot burner, a flame sensor provides a signal to a control circuit which actuates a relay to switch the spark ignitor circuit off and to energize the main burner valve solenoid, turning on the main burner which is ignited by the pilot burner. A control system of this general type is shown in the co-pending application Ser. No. 590,410, filed June 26, 1975 and now U.S. Pat. No. 3,986,813. Other prior art systems are identified in said co-pending application.

If for any reason the pilot burner does not ignite, the main burner valve solenoid will not be energized. Similarly, if the pilot burner flame goes out while the main burner is on, the outage will be noted by the flame sensor with the control circuit turning the main valve burner off and again energizing the pilot spark ignition circuit. This operation protects against the possibility of the main burner valve being open while the pilot flame is out. However there is always a possibility that a component in the electronic circuit will malfunction with the result that the main burner solenoid may be energized even though there is no pilot flame. Accordingly, it is an object of the present invention to provide a new and improved control system which will have a fail safe operation for every component in the main control circuit, that is, if any component fails such as by shorting or open circuiting, the main burner valve cannot be opened. A further object is to provide such a system wherein the control circuit is of the analog-digital type with the flame sensor output being an analog measurement while the remainder of the control operation is digital in nature.

SUMMARY OF THE INVENTION

A pilot ignition and valve control system for a gas burner having a main burner, a main valve operated by a main solenoid for providing gas to the main burner, a pilot burner, a pilot valve operated by a pilot solenoid for providing gas to the pilot burner, a spark igniter circuit, ignition electrodes and a flame sensor adjacent said pilot burner, a pair of input terminals for connection to a power source through a thermostat switch or the like and for connection to the pilot solenoid whereby the pilot solenoid is energized and gas is supplied to the pilot burner when the switch is closed, and a switching circuit for connecting the spark igniter circuit to the power terminals when in a first condition for igniting the pilot burner and for connecting the main solenoid to the power terminals when in a second condition for supplying gas to the main burner. The main control circuit includes a relay coil for operating the switching circuit, a transistor for powering the relay coil and a gate circuit with output connected to the base of the transistor for controlling the transistor. The flame sensor is connected as an input to an operational amplifier with the amplifier output and a reference voltage serving as inputs to the gate circuit whereby the transistor is switched into conduction by a sensed pilot burner flame via the operational amplifier and gate circuit energizing the relay coil and supplying gas to the main burner. A plurality of auxilliary circuits are connected with the main control circuit to ensure fail safe operation for failure of any component in the main circuit. Another transistor is connected to ground the relay coil blocking operation for various low and high voltage conditions in the main circuit which may result from short circuit and/or open circuit malfunctions. Additional gate circuits, preferable CMOS exclusive nor gates, provide digital type sensing for undesired low and high voltage conditions. An additional relay and transistor control a switching circuit in the main control circuit blocking operation if there is a failure in the main relay grounding transistor.

DESCRIPTION OF THE PREFERRED EMBODIMENT

Figure 1:
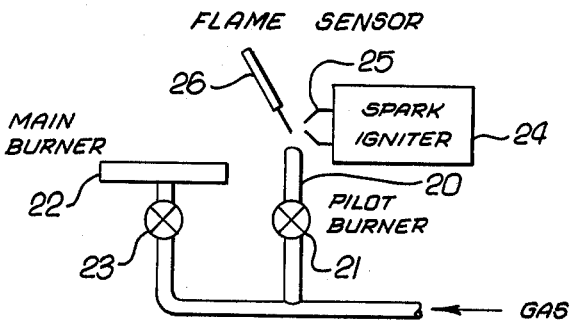
FIG. 1 is a diagram illustrating a pilot and main burner installation.

FIG. 1 illustrates a typical gas furnace burner installation. All of the components illustrated are conventional. Gas is supplied to a pilot burner 20 through a pilot burner valve 21 and to a main burner 22 through a main burner valve 23. A spark igniter 24 is positioned with its electrodes 25 adjacent the pilot burner. A flame sensor 26 is similarly positioned adjacent the pilot burner. The pilot burner valve 21 is controlled by a pilot valve solenoid 30 (FIG. 2) and the main burner valve 23 is controlled by a main valve solenoid 31.

In a normal operating sequence, the pilot valve solenoid is energized, opening the pilot burner valve and admitting gas to the pilot burner. The spark igniter is energized and the sparks between the electrodes ignite the gas, providing a flame at the pilot burner. The flame sensor senses the pilot flame and operating through the control circuit, energizes the main valve solenoid which opens the main burner valve, admitting gas to the main burner. The main burner is ignited by the pilot burner. If the pilot burner flame is extinguished for any reason, this is noted by the flame sensor and the main valve solenoid is deenergized, shuting off gas to the main burner.

Figure 2:
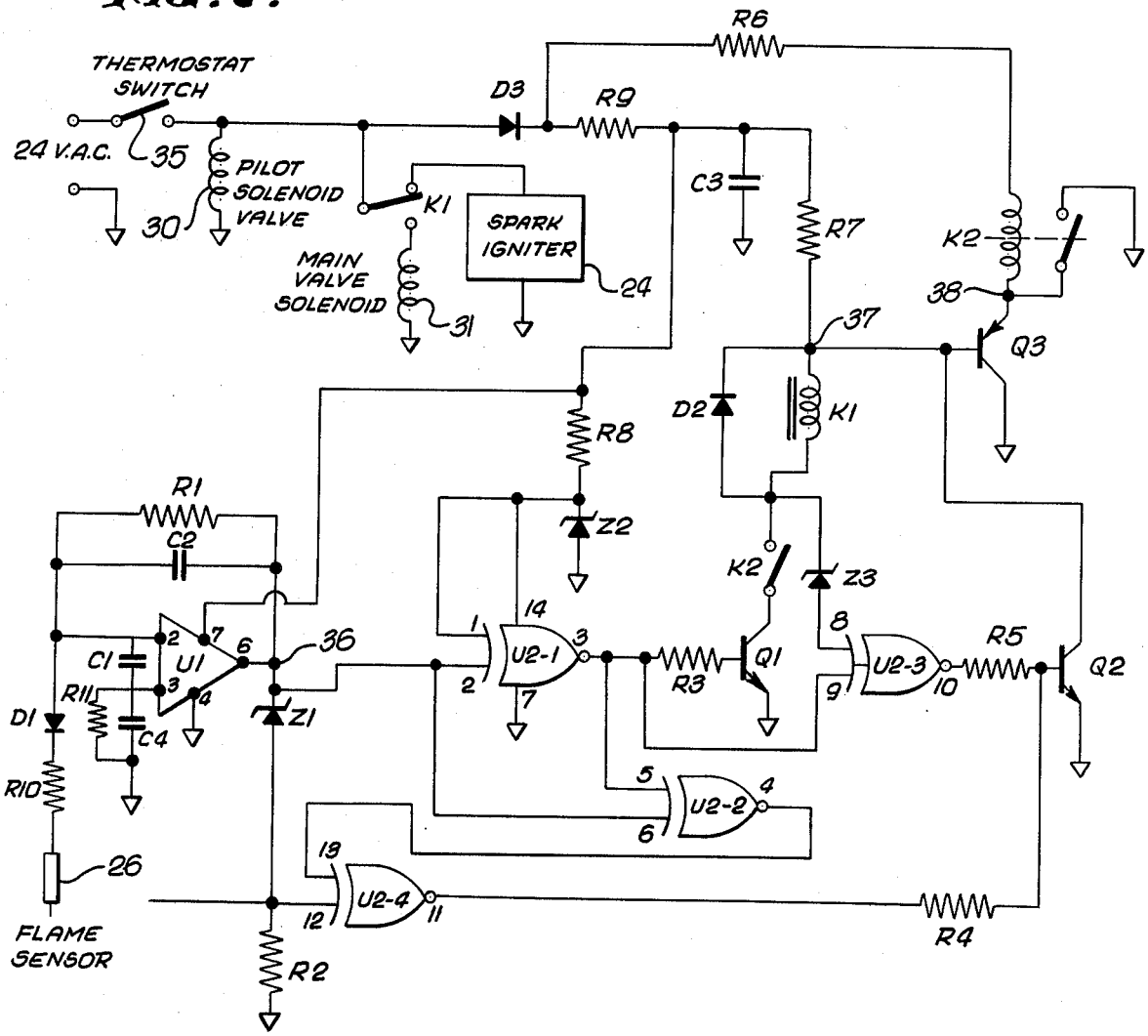
FIG. 2 is an electrical schematic of a control system for the burners of FIG. 1 incorporating the presently preferred embodiment of the invention.

The electrical circuitry for this system is illustrated in FIG. 2, where a thermostat switch or other type of switch 35 connects the system to a power source, here 24 volts ac, when it is desired to activate the main burner. The main control circuit includes an operation amplifier U1, a gate circuit U2-1, a transistor Q1 and the coil of a relay K1. When the relay K1 is unenergized, the spark igniter 24 is connected to the power source through the switch 35. When the relay K1 is energized, the main valve solenoid 31 is connected to the power source through the switch 35.

Diode D3 functions as a rectifier for the ac source to provide a dc supply for the electronic circuitry, with resistor R9 and capacitor C3 serving as a filter. Resistor R8 and zener diode Z2 provide a fixed reference voltage for gate U2-1. Resistor R7 is connected in series with the coil of relay K1 to serve as a current limiting resistor and diode D2 is connected across the relay coil to provide a discharge path when the coil is deenergized. The presently preferred components and values for the circuit are set out in the attached Table of Components.

Table of Components

| | | | |
|---|---|---|---|
| Q1 | 2N2219 | R1 | 50 megohms |
| Q2 | 2N2219 | R2 | 5.6 kohms |
| Q3 | 2N2905 | R3 | 2.2 kohms |
| D1 | IN4003 | R4 | 2.2 kohms |
| D2 | IN4003 | R5 | 2.2 kohms |
| D3 | IN4003 | R6 | 220 ohms |
| Z1 | 4.7v. | R7 | 180 ohms |
| Z2 | 3.6v. | R8 | 1.3 kohms |
| Z3 | 20v. | R9 | 20 ohms |
| U1 | CA3140 | R10 | 4.7 megohms |
| U2 | CD4077 | R11 | 22 megohms |
| C1 | 0.01 μf | | |
| C2 | 0.0047 μf | | |
| C3 | 250 μf | | |
| C4 | 0.47 μf | | |

The output of the operational amplifier U1 is connected to the input 2 through resistor R1 and capacitor C2. Capacitor C1 is connected across the inputs to serve as a spark supresser, with the input 3 connected to circuit ground through capacitor C5 and resistor R11. The flame sensor 26 is connected to the input 2 through resistor R10 and diode D1.

Under normal operating conditions with no pilot flame, the voltage at point 36, the output of amplifier U1, will be zero. When there is pilot burner flame, the voltage at point 36 will increase to about 3.6 volts. With a cold start, this will take about 10 seconds.

Figure 3:
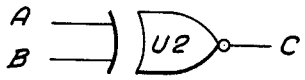
FIG. 3 is a diagram illustrating the operation of the gate circuits of FIG. 2

The four U2 gates are exclusive NOR gates, preferably of the CMOS type. The gates are digital in nature and the output state for various input combinations is set out in FIG. 3 where H indicates a high voltage level and L indicates a low voltage level. Input terminal 1 of U2-1 is at the reference value of 3.6 volts. When point 36 rises to 3.6 volts, both inputs of U2-1 will be high and the output at terminal 3 will go high. This output is connected to the base of transistor Q1 through coupling resistor R3 and switches Q1 into conduction. With relay contact K2 closed, conduction of Q1 energizes the coil of relay K1 which actuates relay switch K1 and connects the main valve solenoid to the power source. If the flame goes out, the amplifier output at point 36 goes down to zero making input terminal 2 of gate U2-1 low and thereby output terminal 3 low, turning off transistor Q1. Therefore it is seen that the main control circuit consists of the flame sensor, the operational amplifier, the gate U2-1, the transistor Q1 and the relay K1.

The fail safe protection circuitry includes transistor Q2 and gates U2-3, U2-4 and U2-2, and relay K2 and transistor Q3. Transistor Q2 is connected in parallel with relay coil K1 and transistor Q1 between resistor R7 and circuit ground. Whenever transistor Q2 is conducting, the coil of relay K1 cannot be energized. The failure of any component in the main circuit will result in transistor Q2 being switched into conduction and relay K1 will remain unenergized.

As shown in FIG. 2, the inputs of gate U2-2 are provided from the outputs of gate U2-1 and the operational amplifier, respectively, with the output of U2-2 providing one input to U2-4. The other input of U2-4 is provided from the point 36 through zener diode Z1 which is connected to circuit ground through reistor R2. The output of U2-4 is connected to the base of transistor Q2 through coupling resistor R4. The output of U2-1 is connected as one input to U2-3, with the other input connected to the relay coil K1 through zener diode Z3. The output of U2-3 is connected to the base of transistor Q2 through coupling resistor R5.

Transistor Q3 and the coil relay K2 are connected in series with resistor R6 across the power supply, with the base of transistor Q3 connected to the junction 37 of resistor R7 and relay coil K1. When the switch 35 is initially closed, transistor Q2 will conduct causing transistor Q3 to conduct energizing the coil of relay K2. This will close the switch K2 between relay coil K1 and transistor Q1 and also connect the junction 38 to circuit ground, thereby maintaining the relay coil K2 energized when transistor Q2 returns to its normal non-conducting state. If transistor Q2 has an open circuit condition due to a malfunction, relay K2 will not be energized when switch 35 is closed, thereby preventing the turnon of the main burner.

If any part of amplifier U1 or the associated components opens or is shorted, the output at point 36 will either stay low at 0 volts or go higher than the nominal 3.6 volts, typically over 5 volts. As described previously, with a low voltage at point 36, the main burner is off. If point 36 goes higher than about 4 volts, the output of gate U2-1 will be low, since input terminal 2 is now high while input terminal 1 is low (see FIG. 3). Both input terminals 8 and 9 of U2-3 will be low, making the output terminal 10 high and switching transistor Q2 into conduction, which in turn grounds resistor R7.

If there is a malfunction in U2-1 or an associated component and the output terminal 3 remains high when the output at 36 goes above the 3.6 volts figure, the circuit is protected via the gate U2-4. Both input terminals 5 and 6 of U2-2 will be high and hence the input terminal 13 of U2-4 will be high. The high voltage at point 36 will produce conduction through the zener diode Z1 causing input terminal 12 of U2-4 to go high, producing a high at output terminal 11 and turning on the transistor Q2.

If Q1 is open circuited, of course the relay coil K1 cannot be energized. If Q1 fails by shorting, and U2-1 output terminal 3 is high, both input terminals of U2-3 will be high producing a high output and switching transistor Q2 into conduction.

If zener diode Z2 is shorted, the output terminal 3 of U2-1 will stay low, holding transistor Q1 off. If capacitor C3 is open, the circuitry will see the rectified ac pulses which cannot provide the power for the control circuit. If capacitor C3 is shorted, the excess current will cause immediate failure of resistor R9 and shut-off power to the circuit. If the flame sensor is grounded, there will be no current at input terminal 2 of amplifier U1 and the output at point 36 will be zero.

The fail safe circuitry provides for preventing current in the relay coil K1 for any malfunction of any component of the main control circuit. This is achieved with reliable solid state components without requiring any capacitors.

I claim:

1. In a pilot ignition and valve control system for a gas burner having a main burner, a main valve operated by a main solenoid for providing gas to said main burner, a pilot burner, a pilot valve operated by a pilot solenoid for providing gas to said pilot burner, a spark igniter circuit, ignition electrodes and a flame sensor adjacent said pilot burner, a pair of input terminals for connection to a power source through a thermostat switch and for connection to said pilot solenoid whereby said pilot solenoid is energized and gas is supplied to said pilot burner when the thermostat switch is closed, and a first switching circuit for connecting said spark igniter circuit to said terminals when in a first condition for igniting said pilot burner and for connecting said main solenoid to said terminals when in a second condition for supplying gas to said main burner, the improvement comprising in combination:

a first relay coil for operating said first switching circuit;

a first transistor with emitter and collector connected in series with said first relay coil across said terminals;

a first gate circuit with first and second inputs and an output connected to the base of said first transistor;

a first means connecting said first gate circuit first input to a reference voltage;

an operational amplifier with first and second inputs and an output connected to said first gate circuit second input;

second means connecting said operational amplifier first input to said flame sensor; and third means connecting said operational amplifier second input to circuit ground, whereby said first transistor is switched into conduction by a pilot burner flame energizing said first relay coil and supplying gas to said main burner.

2. A system as defined in claim 1 wherein said operational amplifier includes a first resistor and a first capacitor connected in parallel between said operational amplifier output and first input.

3. A system as defined in claim 2 including a first diode and a second resistor connected in series between said operational amplifier first input and said flame sensor.

4. A system as defined in claim 1 wherein said first means includes a first resistor and a first zener diode connected in series at a first junction and across a dc voltage source, with said first junction connected to said first gate circuit first input, with said first gate circuit providing a low voltage at the output thereof when the second input is less than the first input by a predetermined value and when the second input is greater than the first input by predetermined value, and providing a high voltage at the output thereof when the second input is substantially the same as the first input.

5. A system as defined in claim 4 including:

a second transistor with emitter and collector connected across said first relay coil and first transistor for shunting said first relay coil; and a first control circuit for switching said second transistor into conduction.

6. A system as defined in claim 5 wherein said first control circuit includes:

a second zener diode and second resistor connected in series at a second junction between said operational amplifier output and circuit ground;

a second gate circuit with first and second inputs and a output connected to the base of said second transistor; and fourth means connecting said second junction to said second gate circuit second input.

7. A system as defined in claim 6 wherein said first control circuit further includes a third gate circuit with first and second inputs and an output connected to said second gate circuit first input, with said first gate circuit output connected to said third gate circuit first input and said operational amplifier output connected to said third gate circuit second input.

8. A system as defined in claim 7 wherein said first control circuit further includes:

a fourth gate circuit with first and second inputs and an output connected to the base of said second transistor;

a third zener diode connected between the junction of said first transistor and first relay coil and said fourth gate circuit first input; and fifth means connecting said first gate circuit output to said fourth gate circuit second input.

9. A system as defined in claim 8 including:

a second switching circuit connected between said first relay coil and first transistor:

a second relay coil for operating said second switching circuit;

a third transistor with emitter and collector in series with said second relay coil across said terminals; and sixth means connecting the base of said third transistor to the junction of said first relay coil and second transistor.

10. A system as defined in claim 1 including:

a second transistor with emitter and collector connected across said first relay coil and first transistor for shunting said first relay coil; and a first control circuit for switching said second transistor into conduction.

11. A system as defined in claim 10 wherein said first control circuit includes:

a first zener diode and first resistor connected in series at a first junction between said operational amplifier output and circuit ground;

a second gate circuit with first and second input and an output connected to the base of said second transistor; and fourth means connecting said first junction to said second gate circuit second input.

12. A system as defined in claim 11 wherein said first control circuit further includes a third gate circuit with first and second inputs and an output connected to said second gate circuit first input, with said first gate circuit output connected to said third gate circuit first input and said operational amplifier output connected to said third gate circuit second input.

13. A system as defined in claim 12 wherein said first control circuit further includes:

a fourth gate circuit with first and second inputs and an output connected to the base of said second transistor;

a second zener diode connected between the junction of said first transistor and first relay coil and said fourth gate circuit first input; and fifth means connecting said first gate circuit output to said fourth gate circuit second input.

14. A system as defined in claim 13 including:

a second switching circuit connected between said first relay coil and first transistor;

a second relay coil for operating said second switching circuit;

a third transistor with emitter and collector in series with said second relay coil across said terminals; and sixth means connecting the base of said third transistor to the junction of said first relay coil and second transistor.

15. A system as defined in claim 10 wherein said first control circuit includes:

a second gate circuit with first and second inputs and an output connected to the base of said second transistor;

a first zener diode connected between the junction of said first transistor and first relay coil and said second gate circuit first input; and fourth means connecting said first gate circuit output to said second gate circuit second input.

16. A system as defined claim 15 including:

a second switching circuit connected between said first relay coil and first transistor;

a second relay coil for operating said second switching circuit;

a third transistor with emitter and collector in series with said second relay coil across said terminals; and fifth means connecting the base of said third transistor to the junction of said first relay coil and second transistor.

* * * * *